United States Patent [19]

Hickman

[11] 4,202,428

[45] May 13, 1980

[54] LADDER

[75] Inventor: Ronald P. Hickman, Waltham Abbey, England

[73] Assignee: Inventec International Limited, Guernsey, Channel Islands

[21] Appl. No.: 829,445

[22] Filed: Aug. 31, 1977

Related U.S. Application Data

[60] Continuation of Ser. No. 719,957, Sep. 2, 1976, which is a division of Ser. No. 558,120, Mar. 13, 1975.

[30] Foreign Application Priority Data

Mar. 14, 1974 [GB] United Kingdom ..... 11457/74
Apr. 11, 1974 [GB] United Kingdom ..... 16263/74

[51] Int. Cl.[2] ..... E06C 1/383

[52] U.S. Cl. ..... 182/22; 182/162; 182/189

[58] Field of Search ..... 182/159, 160, 161, 162, 182/189, 100, 22, 23; 211/178 R

[56] References Cited

U.S. PATENT DOCUMENTS

| | | | |
|---|---|---|---|
| 19,107 | 1/1858 | Stone | 182/159 |
| 1,283,424 | 10/1918 | Poetz | 182/200 |
| 1,606,445 | 11/1926 | Pirsch | 182/159 |
| 3,978,944 | 9/1976 | Hickman | 182/162 |
| 4,016,954 | 4/1977 | Hickman | 182/162 |

*Primary Examiner*—Reinaldo P. Machado
*Attorney, Agent, or Firm*—Brumbaugh, Graves, Donohue & Raymond

[57] ABSTRACT

A foldable ladder is disclosed having a central and two outer parallel support members or "stiles" and a plurality of steps connected between the central and the outer stiles. Each step is arranged to fold between an erected position, in which it extends generally at right angles to the longitudinal direction of the stile to which it is connected, and a storage position in which the step lies generally parallel to the central stile with the outer stile to which it is connected extending parallel to and in close juxtaposition with the central stile. Engaging means are provided adjacent the upper end of the central stile for holding cooperating engaging means of a supporting member such as another ladder section (forming an extension ladder) or a prop extending to ground (forming a step ladder).

33 Claims, 27 Drawing Figures

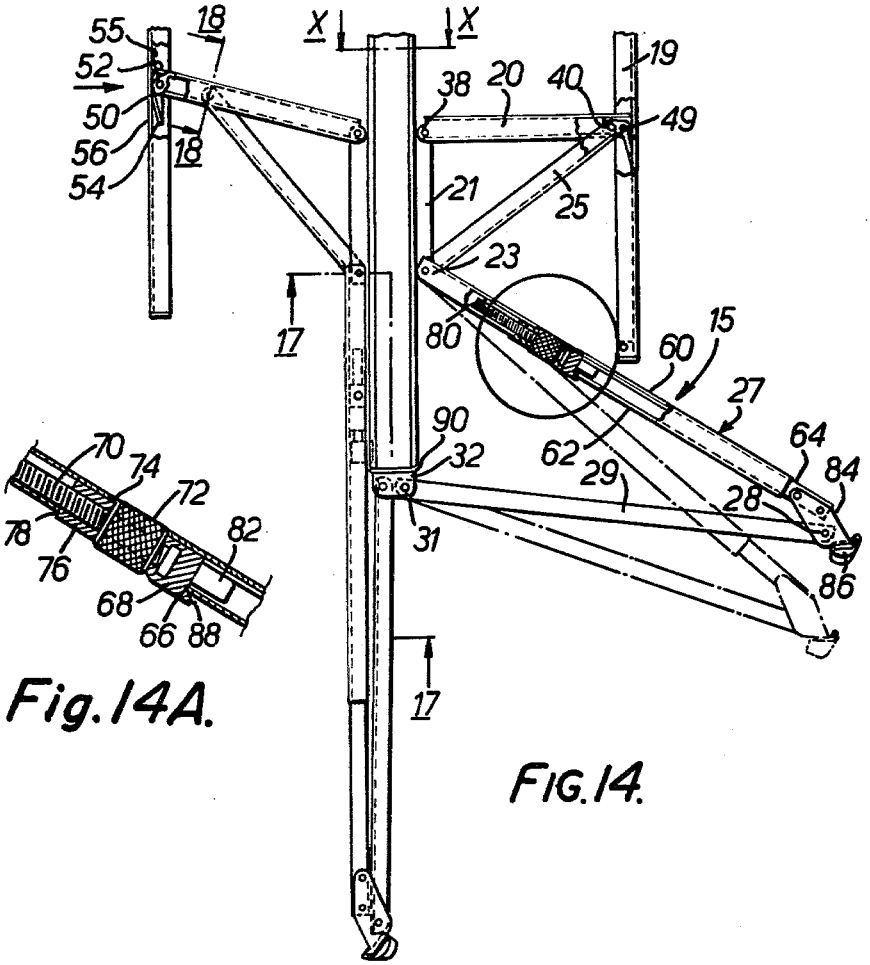
Fig. 14A.
FIG. 14.
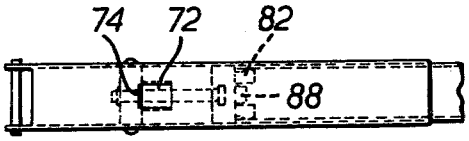
FIG. 15.

LADDER

This is a continuation, of application Ser. No. 719,957, filed Sept. 2, 1976 which, in turn is a divisional of Appln. Ser. No. 558,120 filed Mar. 13, 1975.

BACKGROUND OF THE INVENTION

The present invention relates generally to the art of ladders and, in particular, to ladders which may be folded to facilitate portability and storage.

As can well be imagined, the design and construction of ladders, in one form or another, may be included among man's oldest technological arts. Notwithstanding centuries of experimentation in this field, however, man has failed to arrive at the "ultimate" ladder: a ladder which may be extended by any number of available sections to reach any desired height; a ladder which may be opened into the "step-ladder" configuration; a ladder which may be stood securely on irregular surfaces or be leaned against an upright surface of any shape without deleterious effect on its stability; a ladder which may be folded to form a single pole which may be easily carried or stored; a ladder which provides non-slip surfaces and human-engineered handrails for safety and convenience of use; and, finally, a ladder which may be manufactured and sold in identical modular sections that can be assembled together to fulfill all of the user's needs, including needs that have never been met before.

SUMMARY OF THE INVENTION

It is an object of the present invention to provide a ladder capable of meeting all of the requirements listed above.

This object, as well as other objects which will become apparent in the discussion that follows, are achieved, according to the present invention, by providing a foldable ladder having at least one section comprising a central elongate member and two outer elongate members arranged one on each side of, and substantially parallel to, the central member; a series of steps each foldably connected to the central member and one of the outer members, each step being arranged to fold between an erected position, in which it extends generally at right angles to the longitudinal direction of each member to which it is connected, and a storage position in which the step lies generally parallel to the central member with the outer member to which it is connected extending parallel to and in close juxtaposition with the central member; and engaging means, disposed on the central member adjacent its upper end, for holding cooperating engaging means of a supporting member. The central and the two outer elongate members thus constitute the three "stiles" of the ladder.

The above construction of the ladder, according to the present invention, permits the central stile to be spaced from a supporting surface by the support member when the ladder section is in a substantially upright, working configuration. For example, the supporting member may be a second ladder section either identical or different from the first, but having also a central stile which may be held adjacent and substantially parallel to the central stile of the first ladder section at a number of extended, partially overlapping positions. The supporting member may also constitute a prop which is pivoted outward from the central stile of the ladder section to form a generally inverted V-shaped ladder configuration.

In the case where the supporting member constitutes another ladder section, the two central members of the two ladder sections may have slidably cooperating parts to provide captive location of one central member behind the other during all, or subsequently all, of their relative movement. According to a preferred feature, the engaging means on the central stiles of the ladder sections may constitute a self-tightening latch which will be described in detail hereinbelow.

According to a further preferred feature of the present invention, the central stile of a ladder section may be constructed so that the steps are angled in the horizontal plane when in the erected position to accomodate the natural splay of the feet of a person using the ladder. According to another feature, the outer stiles may be constructed with a U shaped cross section so that the steps may be received within these stiles when folded to the storage position.

The ladder according to the present invention may be supported on the ground in a number of ways. In one preferred embodiment the outer stiles of the supported section extend downwardly beyond the lower end of the central stile to support the ladder. In another preferred embodiment the support for the ladder is provided at the lower end of the central stile. This may be accomplished by providing at least two leg structures connected to the central stile adjacent its lower end. These leg structures are conveniently provided with means for adjusting the positions of their outer ends, thereby permitting individual height adjustment to adapt to an uneven supporting surface. Like the ladder itself, the leg structures may be constructed so as to be capable of folding to a storage position in which they lie generally parallel to the central stile. Preferably, the steps and outer members may be foldable upward and the leg structures foldable downward on the central stile to the storage position.

When two ladder sections are used together, it is advantageous to provide means for locking the second section to the first when the central stiles thereof are in an aligned, parallel configuration, to permit the two ladder sections to be conveniently transported.

It will be appreciated that the ladder structure according to the present invention makes possible a so-called Uni-modular design whereby the ladder is comprised of one or more identical ladder sections. In this case, since it is necessary only to provide supporting leg structures for the lowest section, means may be provided on the central stile of each ladder section for detachably retaining such leg structures.

BRIEF DESCRIPTION OF THE DRAWINGS

The invention may be carried into practice in a number of ways but certain specific embodiments will now be described with reference to the accompanying drawings in which:

FIG. 14 is a front elevation with certain parts shown in cross-section of the lower end of a ladder section the Figure being drawn for clarity in the direction of the arrows A—A of FIG. 17 and showing, on the left, a step partly folded and a leg fully folded and, on the right, a step and a leg in working positions;

FIG. 15 is a view generally in the direction of the arrow 15 of FIG. 14 showing the top of a leg strut;

DESCRIPTION OF THE PREFERRED EMBODIMENTS

Figure 1:
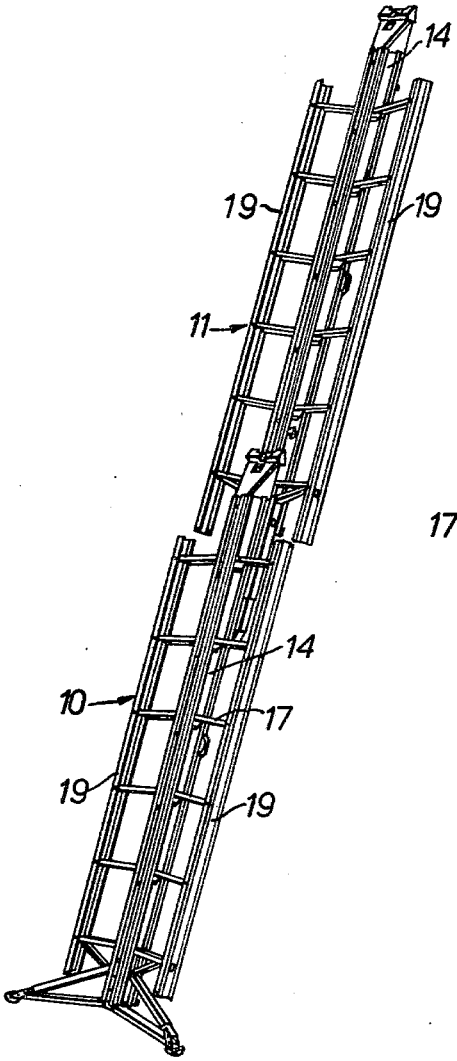
FIG. 1 is a perspective view of two ladder sections in an extended position.
Figure 3:
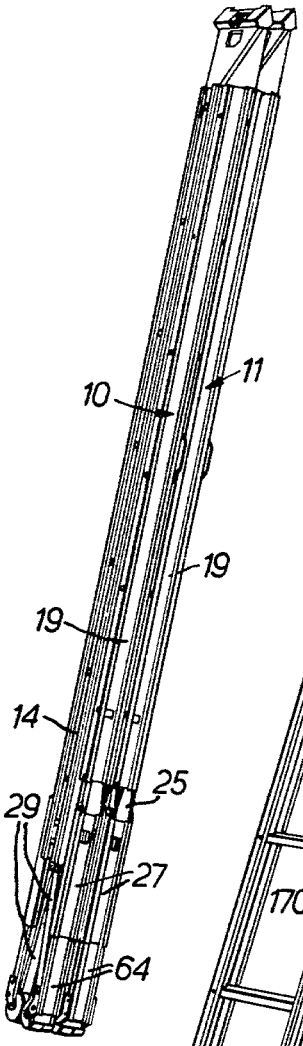
FIG. 3 shows the two ladder sections stored one against the other.
Figure 2:
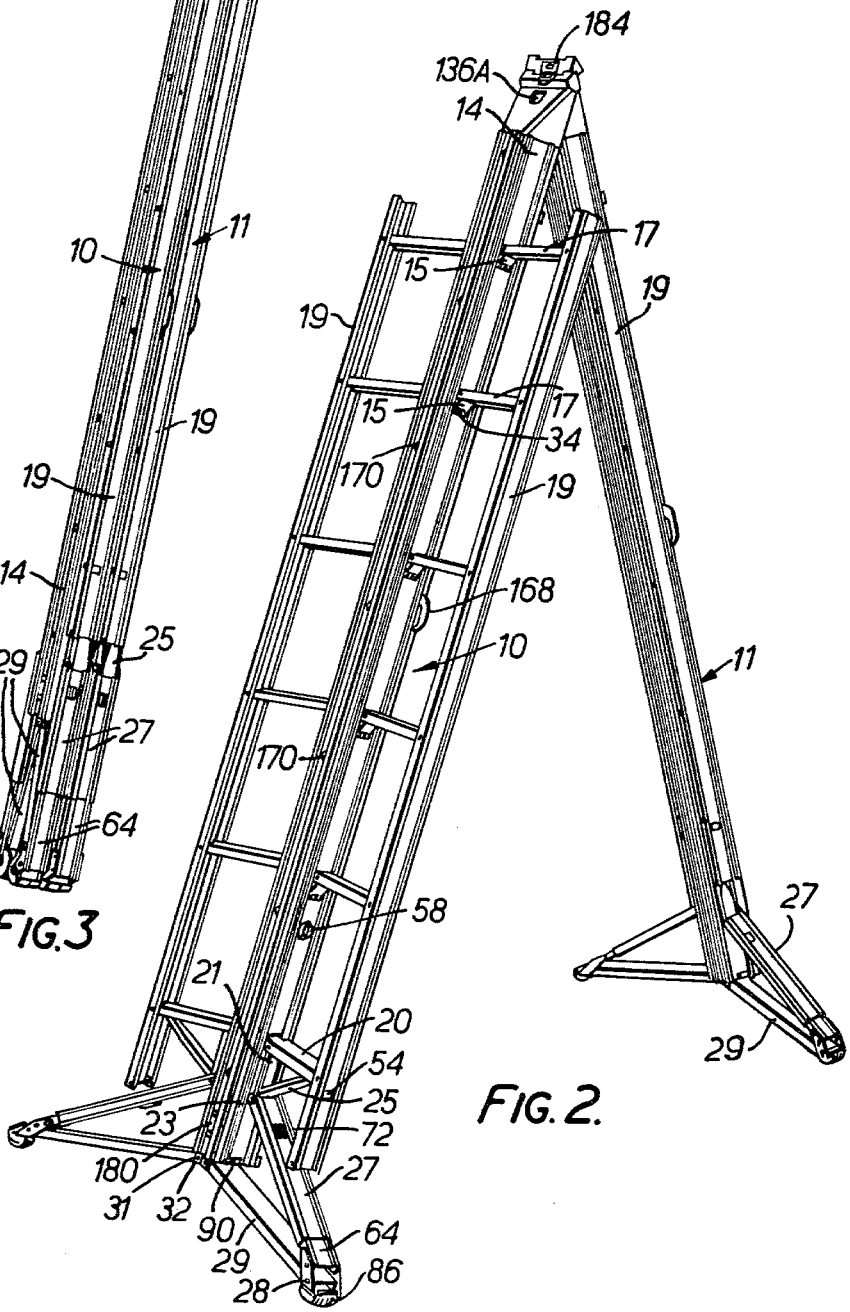
FIG. 2 illustrates two ladder sections in inverted V-form to make a step ladder.

The ladder illustrated in FIGS. 1 to 3 has two identical sections generally indicated at 10 and 11. While it will be convenient to refer to the section 10 as the front section and the section 11 as the rear section, it will be appreciated that these sections, because they are identical, are completely interchangeable. FIG. 3 shows the two sections 10 and 11 in a storage condition in which they lie in close juxtaposition. From the storage position the sections can be alternatively moved to the extended position of FIG. 1, or to form an inverted V-shaped step ladder, to the position of FIG. 2.

Each ladder section includes a longitudinal central support stile 14 formed as an aluminum extrusion. The cross-section of this extrusion is shown clearly in FIGS. 4, 5 and 6, and will be referred to in detail later. Secured at spaced intervals along each side of the stile 14 are step brackets 15 to which are pivoted steps 17 shown in a working position in FIGS. 1 and 2. Interconnecting the outer ends of the steps 17 on each side are a pair of longitudinally generally U-section side or hand rails 19. Each of the lower steps 20 is pivoted at its inner end to the upper end of a support plate 21 instead of a bracket 15. Extending between a pivot 23 adjacent the lower end of the plate 21 and an outer region of the step 20 is a step strut 25, the detail of which will be referred to later. Also mounted to pivot on the pivot 23 is a leg strut 27 which is pivotally mounted at 28 to the outer end of a leg 29 the inner end of which is connected by a pivot 31 to a leg support bracket 32, the detail of which is shown at the lower end of FIG. 7.

It will be noted that the folded form of the ladder shown in FIG. 3 makes it extremely compact and readily portable. The handrails when folded, together with the folded leg assemblies on each side are compact and substantially in line with one another.

Figure 4:
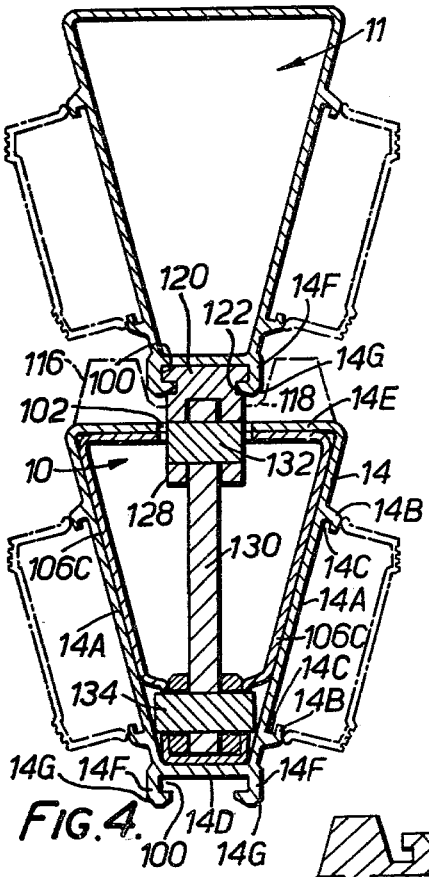
FIG. 4 is a sectional plan on the line 4—4 of FIG. 12.
Figure 5:
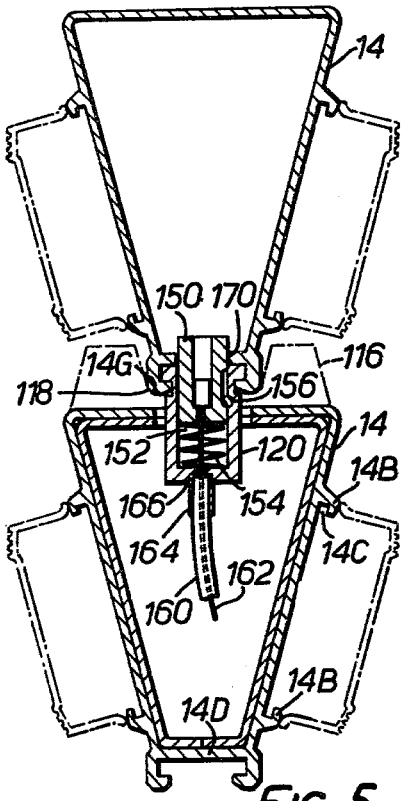
FIG. 5 is a sectional plan on the line 5—5 of FIG. 13.
Figure 6:
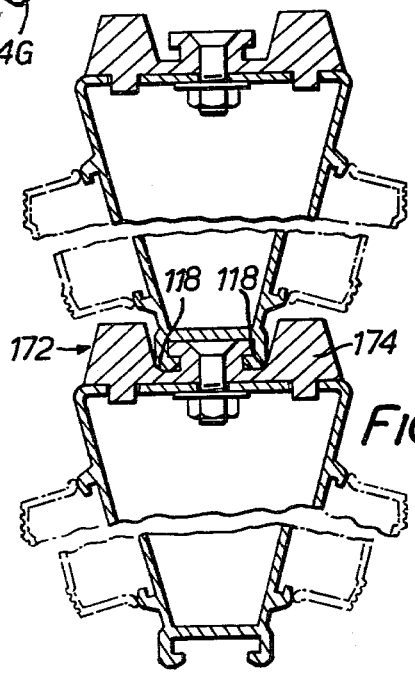
FIG. 6 is a sectional plan on the line 6—6 of FIG. 8.

Returning to the cross-section of the ladder stiles shown in FIGS. 4, 5 and 6, it will be seen that each stile has a side wall 14A, the two side walls being inclined to one another as shown in FIG. 4, so that the cross-section of the stile is somewhat triangular in shape.

Since the steps project at right angles to the side faces of the stile, it follows that the steps themselves are not in line, in plan view. In fact they subtend an angle of 150°, this complying with the natural splaying of the user's feet in normal standing position.

Figure 7:
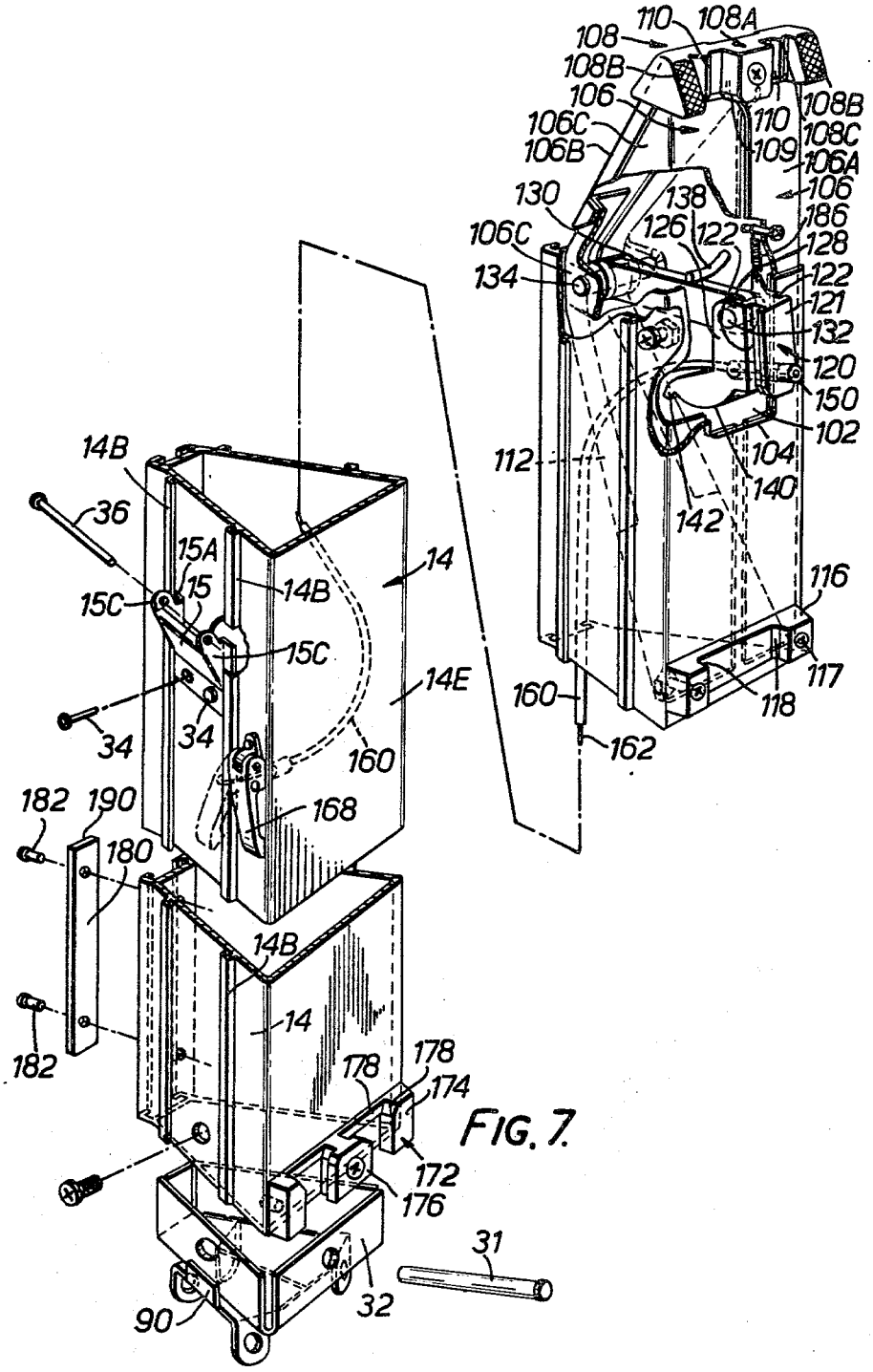
FIG. 7 is a perspective view with certain parts broken away of one section of ladder.

Integrally extruded on each side wall are a pair of ribs 14B which define between them spaced channels 14C within which the step brackets 15 and the plate 21 are located. Each step bracket is secured to the side wall 14A of the stile by a pair of rivets 34 shown in FIGS. 2 and 7. FIG. 7 shows the detail of the step brackets 15. Each bracket has two outwardly directed flanges 15A received in one of the two channels 14C. This accurately locates the brackets 15 with respect to the ladder stile 14 and outward or horizontal twisting movements of the inner end of the steps is effectively absorbed by co-operation of the flanges 15A with the ribs 14B. Each step bracket has a pair of vertical lugs 15C to which the inner ends of the steps are secured by means of pivot pins 36.

Figure 18:
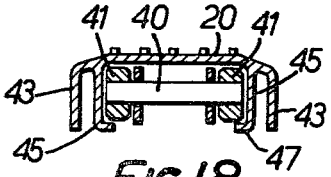
FIG. 18 is a section on the line 18—18 of FIG. 14.

As has been mentioned in reference to FIG. 2, the lowermost step 20 is mounted at its inner end to a vertical plate 21 secured to the stile and which is also shown in FIG. 14. The lowermost step 20 is of inverted U-form with double side walls 42 and 45. The pivotal connection between the step 20 and the plate 21 comprises two rivets 38. Continuing to refer to FIG. 14, the step strut 25 and the leg strut 27 are each shown pivotally connected at 23 at the lower end of the plate 21. The upper end of the strip strut 25, as shown in FIG. 18, carries a transverse pin 40 having a slider 41 mounted at each end, the sliders being retained within the cross-section of the step 20 by inner walls 45, having at their lower ends inturned flanges 47 which slidably retain the sliders 41. Thus in the operative position of the steps and the side rail 19, the sliders abut a pivot 49 by which the lower step 20 is connected to the side rail and in this position the step strut 25 takes loads received downwards from the weight of a man on either the step 20, in which case the loads are directly applied to the strut 25, or on the five upper steps 17, in which case the load is transmitted to the step strut 25 via the side rail 19.

The side rail and steps are maintained in their operative positions by means of a latch 50 which is pivoted on the pivot 49. The latch 50 has a hooked arm 52 to overlie the pin 40 as shown on the right-hand side in FIG. 14. The latch 50 also has a finger button portion 54 which can be pressed inwards in the manner indicated by the arrow on the left-hand side of FIG. 14 when release of the strut 25 is required to enable the hand rail and steps to be pivoted to an inoperative position, for example as in FIG. 3. For this purpose the side rail has an aperture 56 in line with the finger button 54, and the latch is spring-biassed into an engagement condition by a spring 55.

When the side rail and the steps are pivoted to the inoperative (closed) position for storage the latch 50 can engage a hook abutment 58 situated on the stile between the lowest step 20 and the next step above it, as shown in FIG. 2. This retains the side rail and steps in the inoperative position.

It has already been mentioned that the leg strut 27 is pivoted to the plate 21 at the pivot 23. The leg strut basically comprises two telescopic sections including an upper section 60 of inverted U channel form, the sides of the U having inwardly directed flanges 62 to locate an inverted U section 64 which telescopes within the section 60. The upper end 66 of the inner section 64 abuts against a moulded plastics abutment 68 carried by the lower end of a screwthreaded rod 70. The rod 70 has mounted on it a knurled knob 72 which is located within an aperture 74 in the top surface of the strut section 60. This also is shown in FIG. 15. The upper side of the knurled knob 72 engages a thrust abutment 76 fixed to the strut section 60 and having a plain bore 78 through which the rod 70 passes. The upper end of the rod carries a circlip 80 to prevent the rod passing through the thrust abutment 76.

The plastics moulded abutment 68 has a pair of integral spring tongues 82 of the form shown in dotted lines in FIG. 15. These tongues engage the internal surface of the side walls of the inner strut section 64 so that when the ladder is lifted bodily the section 64 does not tend to slide out. By rotation of the knurled knob 72 the position of the abutment 68 can be adjusted so as to control the length of the whole strut 27 for height adjustment. In chain dotted lines in FIG. 14 an alternative adjusted position of the leg assembly is shown. The leg strut 27 and the leg 29 are interconnected by a pair of side plates 84 of a U-shaped pressing to the base of which a rubber foot 86 is secured.

The plastics moulded abutment 68 has a tongue 88 formed thereon which projects downwardly from the underside of the strut 27. This serves to engage over a hook 90 formed on the leg bracket 32 when the leg assembly is folded down to the storage position shown on the left-hand side of FIG. 14. The knurled knob 72 can be adjusted so as to hold the tongue 88 over the hook 90.

Figure 16:
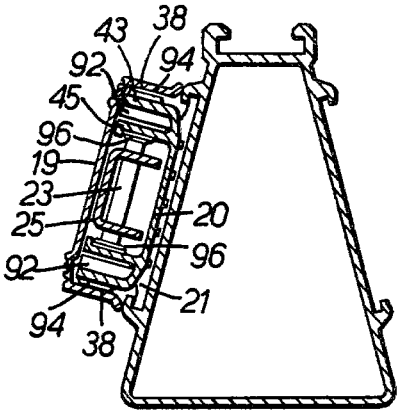
FIG. 16 is a sectional plan generally on the line X—X of FIG. 14 but with the left-hand side rail and lower step and strut in a folded position.
Figure 17:
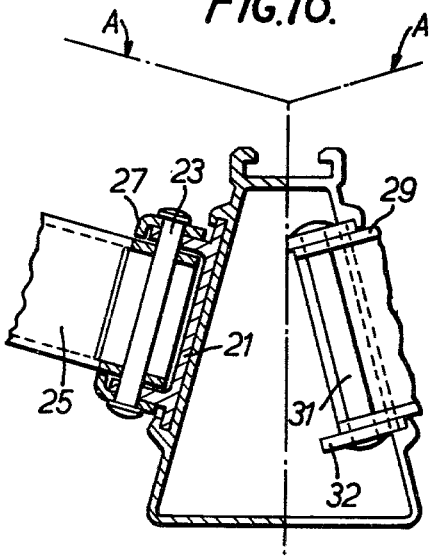
FIG. 17 is an under plan on the line 17—17 of FIG. 14.

Referring to FIG. 16, this shows a cross-sectional plan through the stile above the pivot of the lowest steps 20 but with the step and side rail folded up into the inoperative positions. It shows that the plate 21 has a pair of flanges 92 to which the inner and outer walls 45 and 43 respectively of the lower step 20 are connected by the rivets 38 each having a head 94 and a peened-over end 96. It will be seen that the step strut 25 passes between the peened ends of the rivets 38 when the parts are in the inoperative (folded storage) position.

Turning again to the cross-section of the ladder stile which is shown in FIGS. 4 to 7, it will be seen that the side walls 14A of the stile are interconnected at their front ends by a front wall 14D. The rear ends of the side walls are interconnected by a rear wall 14E. The front wall 14D has at each end an integral hook 14F which between them form a generally open channel 100 and which also afford forwardly and outwardly facing surfaces 14G.

The rear wall 14E is generally flat but adjacent the upper end of the stile it has a generally rectangular slot 102 the lower wall 104 of which is shown in FIG. 7.

The upper end of the stile 14 has a head assembly comprising a pair of steel pressings 106 each of which affords a rear vertical wall 106A, a tapered front wall 106B and a side wall 106C. The pressings at their upper ends are covered by a nosing block 108 which affords a central vertical rectangular cross-section portion 108A having lead-in surfaces 109 on its lower side, and a pair of inclined spaced wall-engaging pads 108B. Between the central portion 108A and the pads 108B, the nosing block has a pair of raised portions 108C which define rearwardly and inwardly facing vertical thrust faces 110, the purpose of which will later be described. The upper end of each ladder section has an angled face which has a generally rectangular recess 136A formed therein as shown in FIGS. 1, 2 and 8–12. This receives the portion 108A of the nosing block of a front ladder section to the FIG. 11 configuration.

The pressings 106 extend down within the upper end of the stile 14. The forward lower wall portions 112 of the pressings are shown in dotted lines. At the lower ends of the side walls 106C of the pressings there is a further block 116 which is secured by screws 117 that also retain the lower ends of the pressings. The block 116 is generally U section in plan as also shown in FIGS. 4 and 5. This block has a further pair of inclined vertical thrust faces 118 the purpose of which will also be described.

Projecting through the slot 102 is a shoe generally indicated at 120 and which has a rear portion 121 provided with a pair of vertical grooves 122, the purpose of which is to receive the hook portions 14F of the rear ladder section as shown in FIGS. 4 and 5 so as to locate and slidably hold the rear ladder section in position behind the front section. The shoe 120 has a front body portion 126 provided with a forked upper end 128 to receive the rear end of a flat link 130. The link is pivoted to the body 126 of the shoe 120 by means of a transverse pin 132 which appears in FIGS. 4 and 7. The forward end of the link 130 is connected to the pressings 106 by a pivot pin 134 as shown in FIGS. 4 and 7.

The link 130 is therefore free to pivot up and down about the pin 134. Upward movement is limited to a horizontal position (as viewed when the ladder is vertical) by a stop 138. The underside of the body portion 126 of the shoe 120 is formed as an arcuate cam 140 terminating in a stop flange 142 which limits rotations of the shoe 120 about the pin 132 by engagement with the rear of the lower periphery of the slot 102 in the stile 14 and pressings 106.

Mounted within the shoe 120 is a retractable latch plunger 150, the detail of which is shown clearly in FIG. 5. Thus the plunger 150 is mounted within a bore 152 in the shoe 120 and is capable of limited movement to and fro with respect to the shoe 120 under the influence of a compression spring 154. Escape is limited by a stop 156. The plunger 150 is thus biased outwards to a projected position shown in FIGS. 5 and 7, but can be retracted by means of a Bowden cable generally indicated at 160, the inner wire 162 of which is connected to the plunger 150 and the outer casing 164 of which engages a recess 166 in the shoe 120. The lower end of the cable 160 is connected to a latch release lever 168 mounted on a side of the stile. Movement of the lever 168 away from the side of the stile causes the plunger 150 to be withdrawn. The front wall 14D of each stile has in it a number of holes 170 (one of which is shown in FIG. 5) to receive the plunger 150. The holes 170 are spaced along the front wall 14D at step-pitch intervals. When the plunger of a front stile is so received in one of the holes 170 of a rear stile, the front and rear stiles are located with respect to one another and only slight relative movement is possible in certain conditions to the extent permitted by movement of the link 130.

Figure 8:
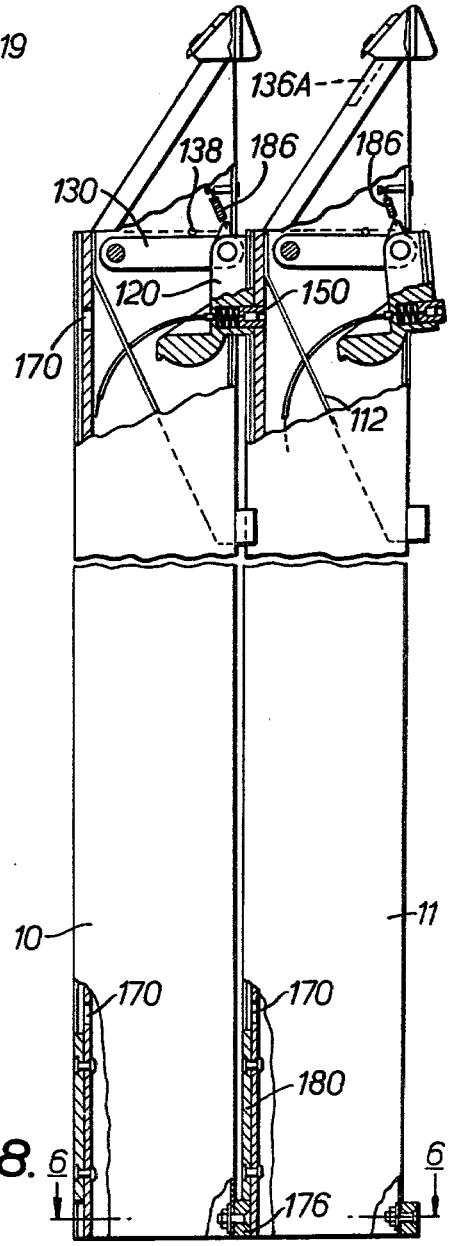
FIG. 8 is a sectional side elevation with certain parts broken away of two sections of ladder in a storage condition.
Figure 9:
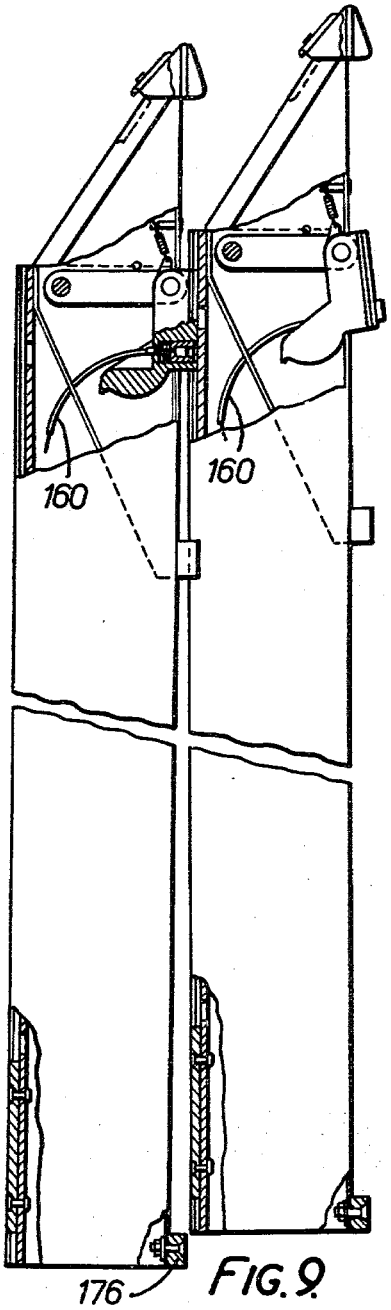
FIG. 9 shows the two sections of ladder of FIG. 8 with the rear section slightly raised and slightly tilted with respect to the front section.
Figure 10:
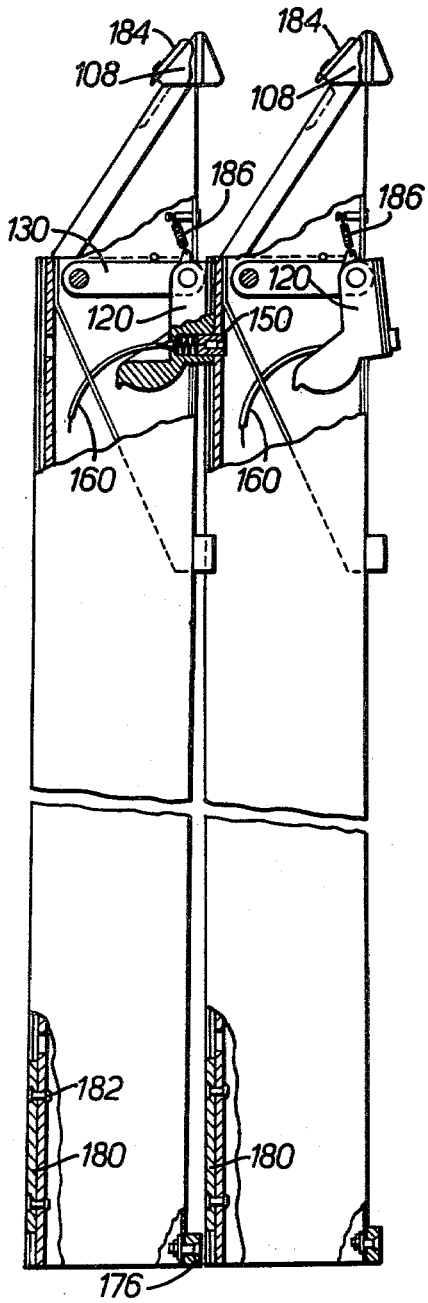
FIG. 10 shows the two sections of FIG. 9 with the rear section lowered slightly.

Adjacent the lower end of the rear wall 14E of the stile, as shown in FIGS. 6 and 7, a third block 172 is provided. This includes a pair of outer portions 174 and a central T-section portion 176. The block 172 has on its upper edges inclined lead-in faces 178. The configuration of the T-shaped portion 176 is such that it can be received within the lower end of the channel 100 formed at the front of the rear stile when the rear stile is to be retained against the front stile in a storage position, as shown in FIG. 8. Thus, referring to FIG. 8, it will be seen that the front and rear stile sections are aligned exactly one with the other and are retained securely against vertical movement in this relative position by means of the plunger 150, the stop 138 for the link 130 and also by abutment of the lower end of a block plate 180 which is shown in FIG. 8 and also in FIG. 7. The block plate 180 is secured within the channel 100 by means of a pair of rivets 182. In this way the rear stile is prevented from downward movement by the engagement of the lower end of the block plate 180 with the upper end of the T-shaped portion 176 of the block 172 and is prevented against rising upwardly because the plunger 150 is engaged in the topmost hole 170 of the rear stile. Upward movement of the shoe 120, which carries the plunger 150, is prevented by the stop 138 which prevents further anti-clockwise rotation of the link 130 in FIG. 8. Thus a number of ladder sections can be retained one against the other for storage or simple transport by an appropriately positioned handle. When it is desired to shift the rear stile section to the inverted V step ladder configuration of FIGS. 2 and 11, the plunger 150 on the front stile is first withdrawn by means of the lever 168, as shown in FIG. 9. This permits the rear stile to be lifted until it is clear of the T-shaped portion 176. The rear section of the ladder, while held up, can then be rotated slightly anticlockwise as shown in FIG. 9, at which time the upper end of the ladder section will still be in engagement with the shoe 120. Therefore the shoe 120 will rotate slightly anticlockwise from the position of FIG. 8 to the position of FIG. 9. The rear section of the ladder can then be lowered to the FIG. 10 position in order to bring the rear section in line with the front section at which time the plunger 150 can again latch the upper ends of the stile sections together but with their lower ends separated. The link 130 in FIG. 10 would now be free to rotate in a clockwise direction although it is biased upwardly by a tension spring 186. The rear section can be pivoted outwards to the FIG. 11 position to form the step ladder configuration. During rotation of the ladder sections to the inverted V-shape it is necessary to ensure that, at the end of such rotation, the link 130 is held in its uppermost position. Unless this is achieved by the spring 186 it is achieved by means of the cam 140 engaging the lower wall 104 of the slot 102.

Figure 11:
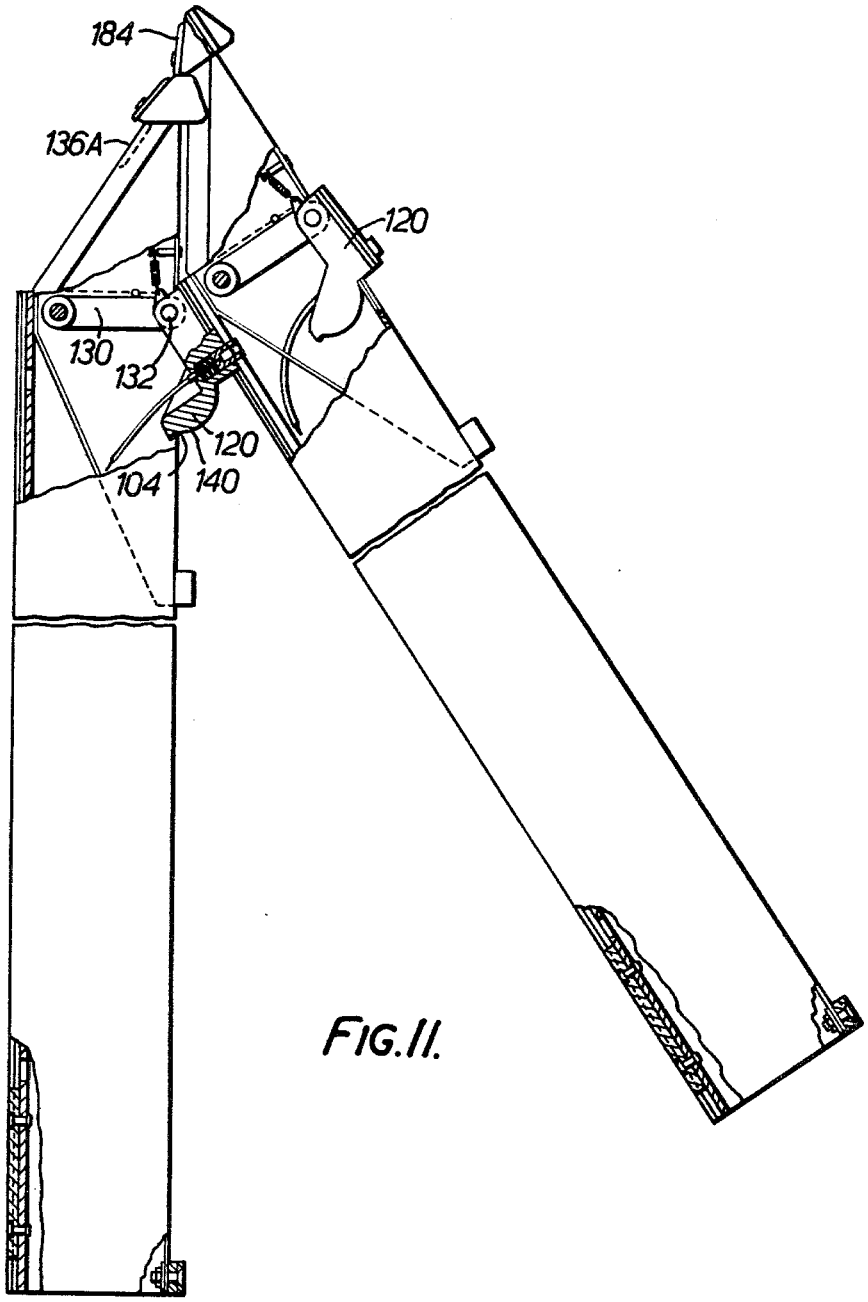
FIG. 11 shows the two sections of ladder in their inverted V configuration.

As has been mentioned, in the FIG. 11 configuration the portion 108A of the nosing block of a front ladder section engages in a recess 136A in the front faces of the pressings 106 of the rear ladder section so providing a good secondary lateral and vertical location of one section relative to the other. During the rotation of the rear section of ladder the nosing block 108 of the rear section will move above the nosing block 108 of the front section. Each nosing block carries a catch 184 which is spring biased downwards. The catch of the rear ladder section can automatically be engaged over the nosing block 108 of the front section as shown in FIG. 11. This retains the parts of the ladder in the configuration shown in FIG. 11. When it is desired to restore the ladder to the FIG. 8 condition the catch 184 can readily be released by manual operation.

Figure 12:
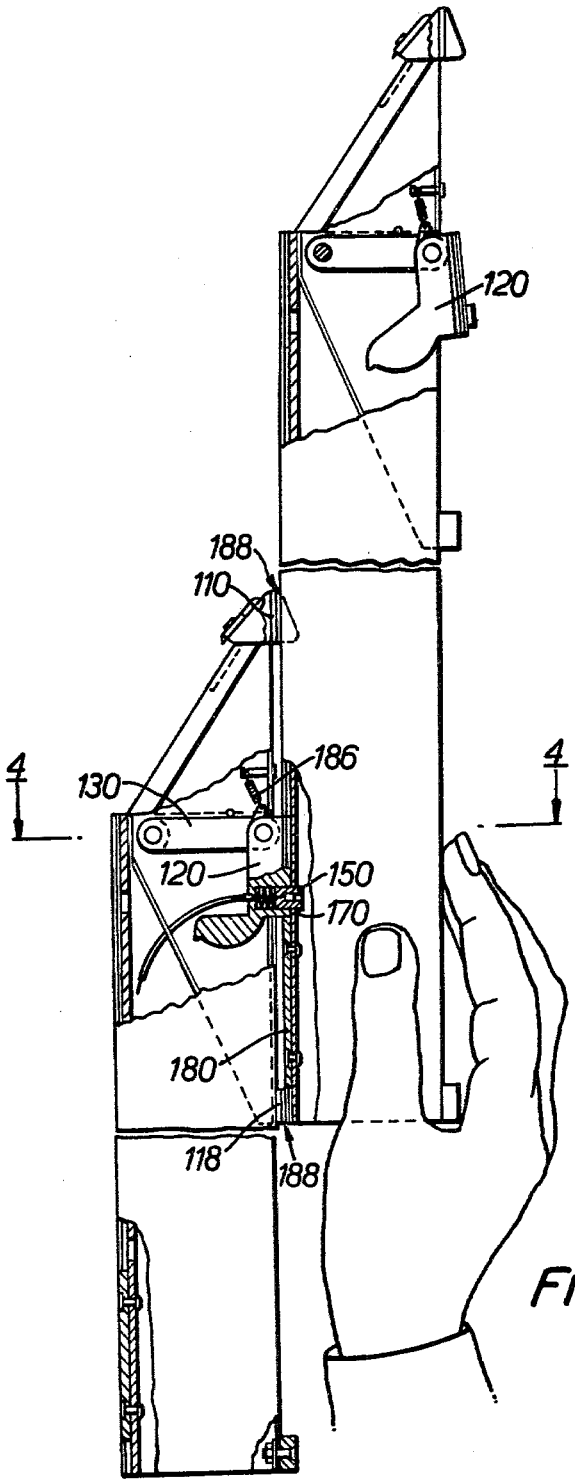
FIG. 12 shows two sections of ladder in an extended position immediately after they have been latched in position and with the rear section still supported manually.
Figure 13:
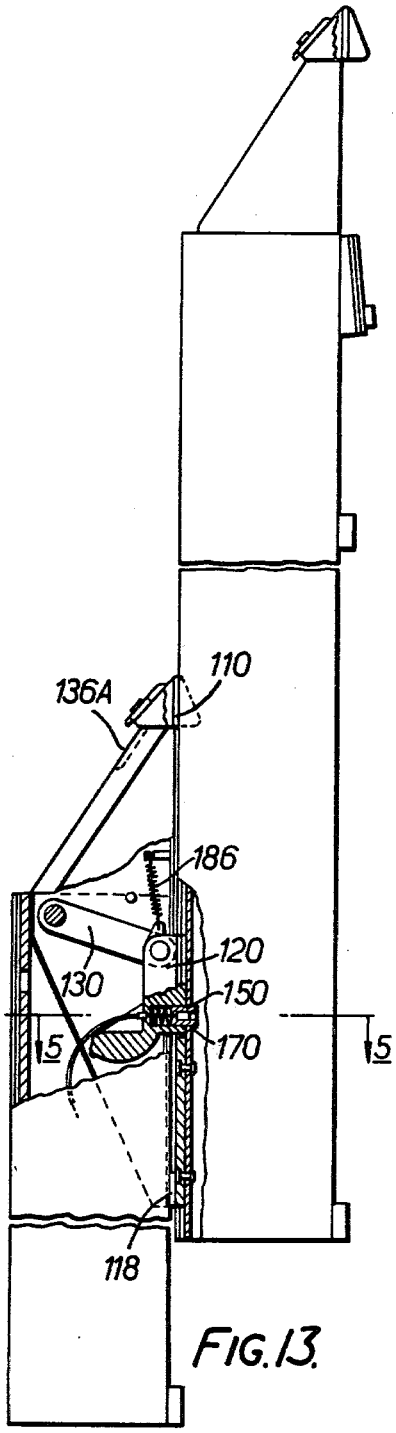
FIG. 13 shows the two sections of ladder of FIG. 12 with the manual support for the rear section removed.

Turning now to FIGS. 12 and 13, these show the manner in which the ladder is extended to the condition of FIG. 1. To move the two sections relatively to one another to the extended position it is to be noted that it is the rear section which is to be raised. Starting from a FIG. 8 or FIG. 10 position the plunger 150 will, of course, be withdrawn whereupon the rear stile can be lifted by hand to any desired degree of extension, for example, to the condition shown in FIG. 12. At this time the link 130 will once again be biased to its upper position by the spring 186. It is to be noted, that with the link 130 in a horizontal position there are slight spacings shown at 188 between the front and rear stile sections as shown in FIG. 12. This permits easy sliding movement of the rear stile with respect to the shoe 120. As soon as the rear section of the ladder reaches the FIG. 12 position the latch release lever 168 is released and the plunger 150 can extend through one of the holes 170 to locate and support the rear section in its extended position. The holes 170 are so spaced that overlapping sections of ladder have their steps in alignment, except that the lowest step on the upper section may be one step pitch above the upper step on the lower section when the sections are fully extended. Extension is also restricted beyond the FIG. 12 position by engagement of the upper end 190 of the block plate 180 with the underside of the shoe 120.

While an upward load is imparted to the rear ladder stile section, the spacings 188 will be maintained. In this condition the ladder sections are not fully stable but as soon as the support for the rear stile section is removed it will drop slightly as permitted by clockwise rotation (e.g., by 5°–20°) of the link 130 to the position shown in FIG. 13. For this reason the upward bias of the spring 186 is less than the downward weight imparted by any single stile. At this time the outwardly facing angled surfaces 14G move into tight engagement with the similarly angled but inward facing thrust faces 110 of the nosing block 108 on the one hand and with the similarly shaped thrust faces 118 of the block 116, with the link 130 in tension. The condition in which the angled contact faces 14G on the forward edge of the rear stile are slightly spaced from the angled faces 118 and 110 of the blocks 108 and 116 is shown in FIGS. 4 and 12. On the other hand the condition in which they are drawn together to locate very positively is shown in FIGS. 5 and 13. The rear ladder section is drawn downwardly and inwardly by its own weight towards the front ladder section. In this position the two ladder sections are automatically securely located thus eliminating play and inhibiting lateral bending and torsional movements. The elevated rear section is strongly supported by the latch plunger 150 which is in shear loading in the hole 170 of FIG. 13. When in use the link 130 is always in tension but one set of the upper or lower abutment and thrust faces will take the prime bending loads (i.e. depending upon which way the extended sections are leaning). In order to ensure that the latch plunger 150 has engaged fully a series of inspection holes may be provided in the side walls 14A adjacent each hole 170. Alternatively a means of visually ascertaining that the lever 168 and also thereby the plunger 150 have returned to their engaged positions may be provided. Alternatively the plunger may be operated to each of its engaged or disengaged positions by a manually reciprocable linkage. Furthermore, lockup means may be used to ensure that the latch plunger cannot be withdrawn when the weight of a rear section is being supported on the latch plunger. For example the latch plunger may be blocked from operating whenever the link 130 is in a downward-rotated position as shown in FIG. 13.

It is believed that the operation of the ladder will be generally apparent from the foregoing description. However it can be stressed that in moving the ladder sections relatively to one another, either to and from an extended, leaning-ladder configuration, or to and from the stepladder configuration, the steps and side rails can either be lowered or not. However it is generally envisaged that the setting up of an extended ladder will best be performed with the steps and side rails in their closed configuration. It can also be useful for some purposes to leave the steps and hand rails 19 of an extended section folded up to facilitate access to the work.

Where it is desired to separate one ladder section completely from the other (or to reintroduce them into engagement with one another), the sections are moved from or into the FIG. 9 configuration, with the plunger 150 held out during appropriate stages of movement. As seen on the rear stile of FIG. 8, the shoe 120 is tilted outwardly slightly to facilitate engagement of a further section.

While in the embodiment of FIGS. 1 to 18 the step strut 25 has been shown associated with the lowest step, it will be appreciated that the strut could be associated with any step, even the top one, in which case the side rail will be placed in tension when steps below the strutted step are used. With a handrail arrangement the outer end of the strut could have sliding engagement on the handrail rather than be connected to the step. It is to be noted that the step struts 25 of a rear section, when extended, are disposed above the foot space of front section step. Moreover, with the leg structures of the rear section folded down as in FIG. 1, these are out of the way of the footspace.

A further modification, not shown, is that where additional ladder sections are used, such sections need not necessarily have the leg assemblies thereon. It is to be noted however that the leg assembly, whether extended or retracted, does not affect the ability of the sections to be extended with respect to one another. In addition, it is not necessary that additional ladder sections be all of the same length.

Figure 19:
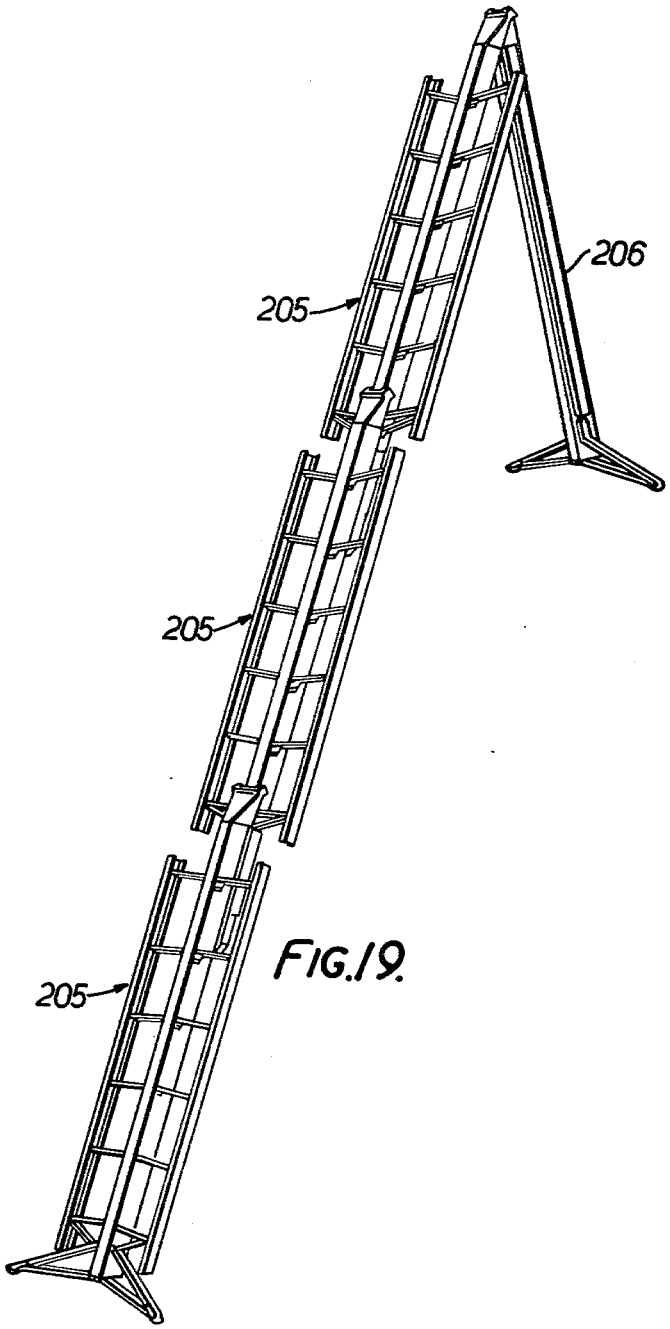
FIG. 19 illustrates a further mode of use of four identical ladder sections.

FIG. 19 illustrates an arrangement in which three ladder sections 205 are arranged in extended formation to form a triple section ladder. In addition a fourth section 206 of identical form is arranged in inverted V form with respect to the top section 205. This illustrates the extreme versatility of the ladder and in particular shows a configuration which can be used on stairs or between the ground and a higher surface.

Figure 20:
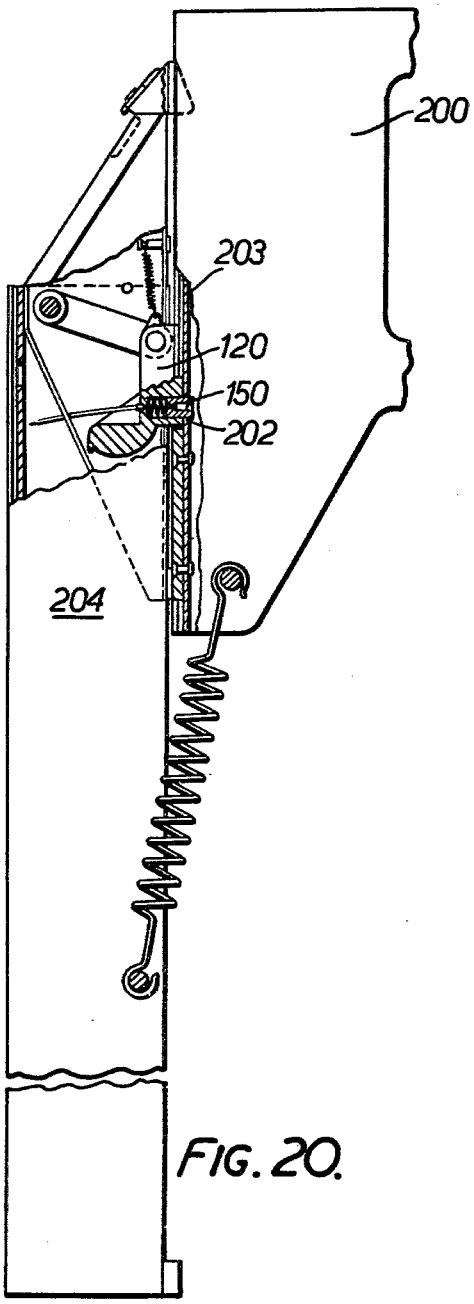
FIG. 20 illustrates an alternative mode of use of the sections of ladder to support a work platform.

FIG. 20 illustrates the use of ladder sections of the type which have been described to support a working platform or scaffold or a gantry, for example carrying an engine lifting hoist. While only one ladder section is shown a similar ladder section will support the opposite end of a platform grid 200 which is provided with an aperture 202 to receive a plunger 150 at the upper end of a ladder section generally indicated at 204. The edge of the grid 200 which abuts the ladder section is formed with a pair of lips or hooks 203 to engage the shoe 120 of the ladder section 204.

Figure 21:
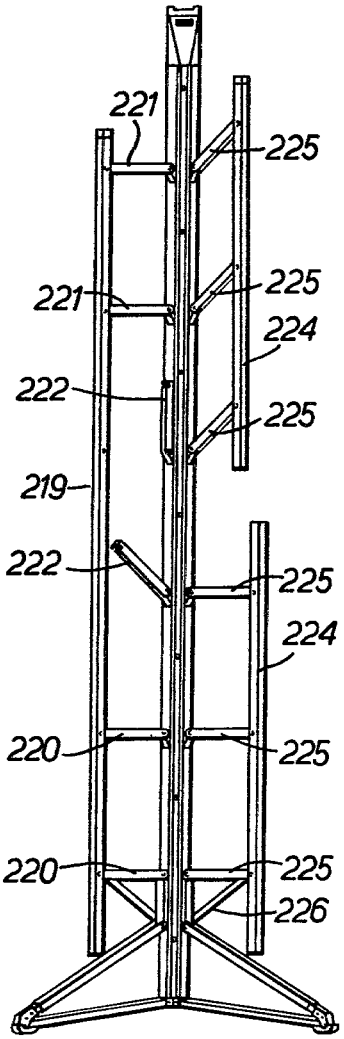
FIG. 21 illustrates two alternative embodiments, one on each side of a ladder section.

FIG. 21 illustrates two alternative embodiments. On the lefthand side a handrail 219 is connected to four steps, namely two lower steps 220 and two upper steps 221. Two intermediate steps 222 are arranged to be capable of movement independent of the handrail, as shown on the left-hand side in FIG. 21. This enables a person using the ladder to be able to work through this section of the ladder, for example when painting, or to be able to stand with knees protruding through the gap formed by the raised intermediate steps 222.

On the right-hand side of FIG. 21 further alternative constructions are shown. A pair of handrail sections 224 are connected each to three steps 225 so that the two handrail sections 224 can be independently operated. The lower handrail section and lower steps are shown supported by a strut 226. While the upper section 224 could be similarly supported, no strut has been shown, to indicate that the steps can be of cantilevered form if desired, the loading on the steps being accommodated at the inboard ends of one or more of them.

Furthermore the leg assembly can be modified. For instance the upper end of the leg strut could have sliding engagement on the stile, or the strut and leg could be connected at their outer ends by a sliding connection.

Figure 22:
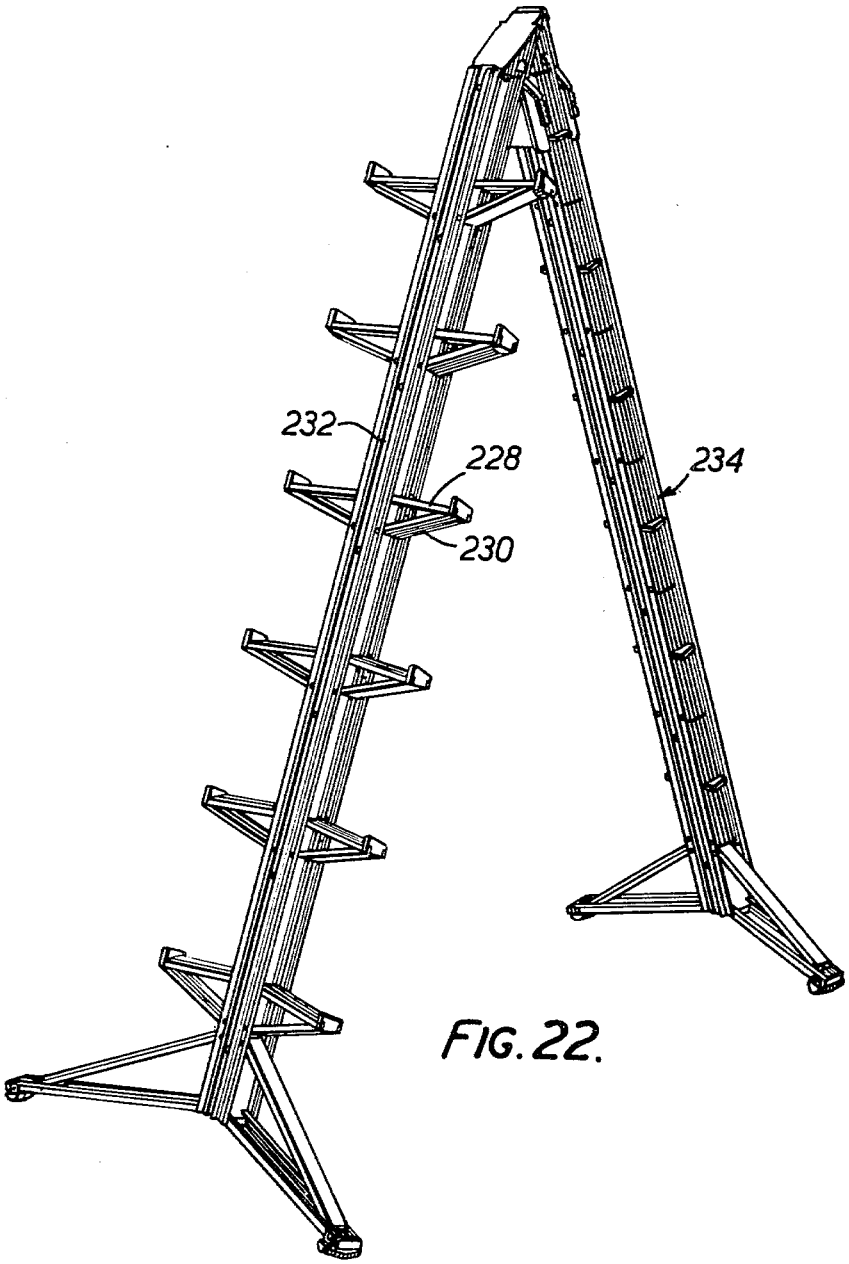
FIG. 22 illustrates a further alternative embodiment comprising two sections of ladder in their inverted V configuration.

FIG. 22 illustrates a still further alternative embodiment in which the side stiles or handrails have been eliminated. This construction requires that each step 228 be independently supported, for example by the separate struts 230. In the embodiment shown, each strut 230 is pivoted at one end with respect to the central stile 232 and at the other end on its respective step 228. When the steps 228 are folded into their closed position as shown on the supporting rear ladder section 234, the inboard ends of the steps (i.e., the ends connected with the central stile 232) slide upward along a groove in the central stile until step and strut lie flat against the stile. In this position, as shown on the ladder section 234, the steps and struts lie longitudinally end to end. These members are retained in this closed position by means of suitable detents on the central stile 232.

In the alternative, the steps 228 may be cantilevered so as to be self-supporting when in the outward or extended position, thus eliminating the need for the supporting struts.

The embodiment of the ladder shown in FIG. 22 provides additional space, for example when painting, since only those steps which are necessary to provide support for the person using the ladder need be opened. A further advantage of omitting the handrails is that bucket of paint or the like may be hung over the end of one of the steps.

FIGS. 23–27 illustrate a still further embodiment of a ladder according to the present invention. In this case, the ladder is not extendable but has a built-in support member or "prop" which may be opened so that the ladder and prop form an inverted V configuration. In this open configuration, the ladder becomes a "step-ladder" of more or less traditional design. Unlike conventional step ladders, however, the ladder according to the invention may be folded together into a single elongate element which is easily portable and requires a minimum amount of storage space.

Figure 23:
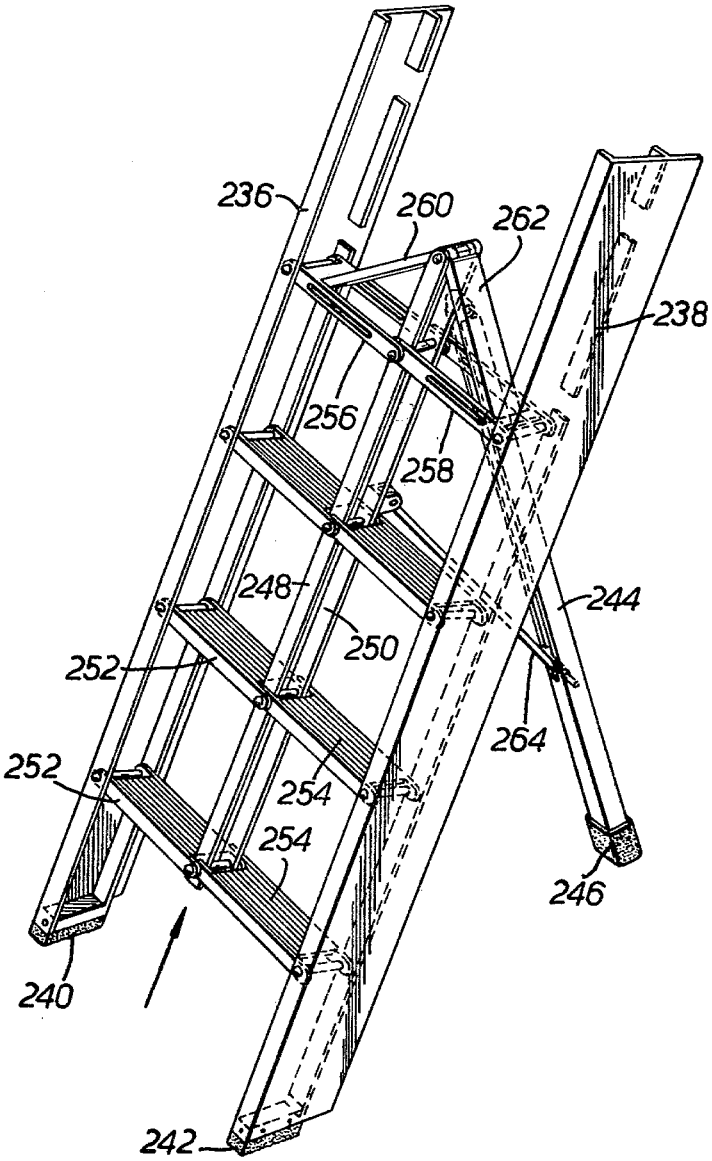
FIG. 23 illustrates a still further alternative embodiment comprising a short "step-ladder" section supported by a prop.
Figure 24:
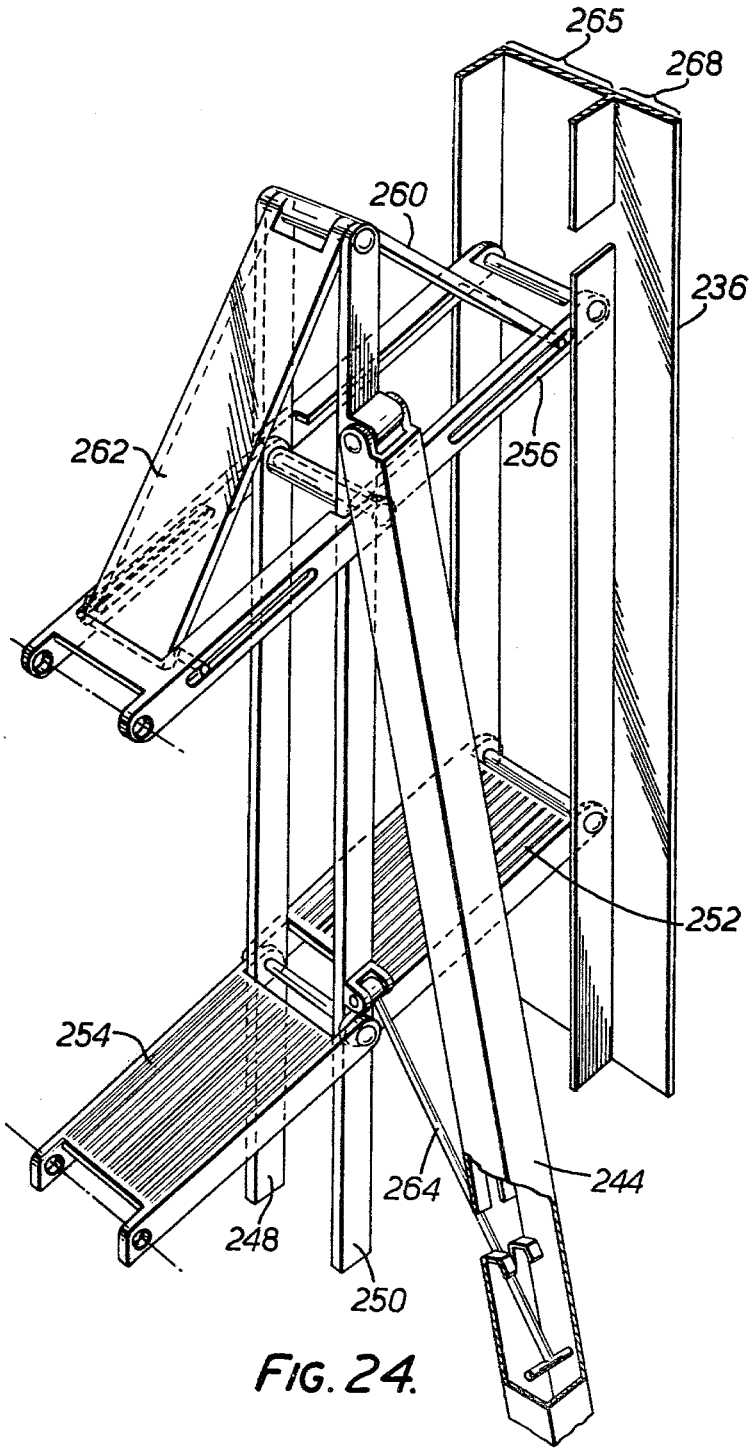
FIG. 24 shows, in detail, a rear portion of the ladder embodiment of FIG. 23.
Figure 25:
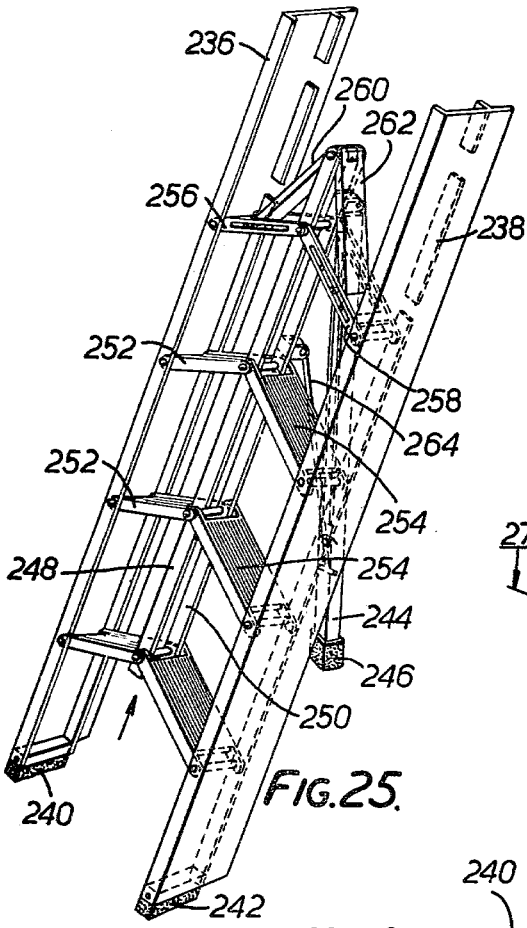
FIG. 25 shows the ladder embodiment of FIG. 23 in the half-folded configuration.
Figure 26:
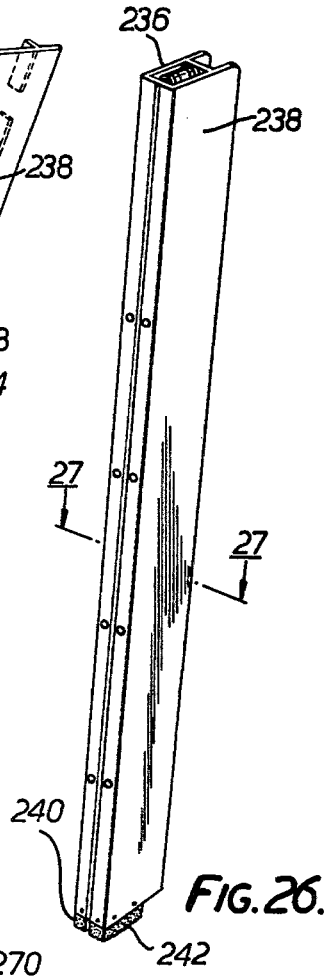
FIG. 26 shows the ladder embodiment of FIG. 23 in the fully folded configuration.
Figure 27:
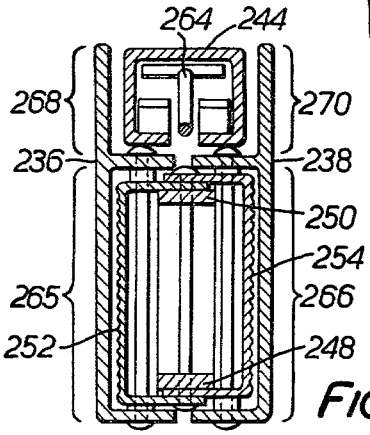
FIG. 27 is a section on the line 27—27 of FIG. 26.

The ladder according to this embodiment is shown in FIG. 23 in the open configuration, in FIG. 25 in the half folded configuration and in FIG. 26 in the fully folded configuration. FIG. 24 illustrates how various elements of the ladder are connected while FIG. 27 shows the respective positions of certain elements in cross-section when the ladder is in the folded configuration.

The ladder of FIGS. 23–27 comprises two outer stiles 236 and 238 having suitable rubber feet 240, 242, respectively, at their lower ends for providing a cushioned slip-resistant support which will not mar the floor surface on which the ladder rests. The single, pole type support member or prop 244 is also provided with a shoe 246 for the same purpose.

In the central part of the ladder, at both front and rear, there are straps 248 and 250 which pivotally support the ladder steps 252 and 254 extending outward in both directions at regular intervals along their length. The steps 252 (i.e., the steps on the lefthand side of the ladder as shown in FIG. 23) are pivotally connected with outer stile 236 whereas the steps 254 (on the right-hand side of the ladder) are pivotally connected with outer stile 238. The straps 248 and 250 extend upward beyond the topmost "steps" 256 and 258 and are pivotally connected at their upper terminus with two support struts 260 and 262. As is illustrated in detail in FIG. 24, the struts 260 and 262 are in captive sliding connection with the upper "steps" 256 and 258, respectively, and, when the ladder is in the open or erected position, they abut against stops in the region of the outer stiles 236 and 238, respectively, so that the central straps 248 and 250 are prevented from moving downward with respect to the outer stiles beyond a point at which the steps 252 and 254 make an angle of approximately 90° with respect thereto, as shown in FIG. 23. In this erected position, the struts 260 and 262 are in compression, whereas the upper "steps" 256 and 258 as well as the central straps 248 and 250 are in tension.

The prop 244 is pivoted to the strap 250 at a point near its upper end, for example between the upper steps 256, 258 and the support struts 260, 262, as shown in FIG. 24. The prop 244 is prevented from pivoting outward away from the strap 250 by an angle greater than approximately 45° by means of a stay 264. This stay has a pivotal connection at one end with the strap 250 and a sliding connection at the other with the prop 244. As the prop is manually moved in the direction of the strap 250 to close the ladder, the lower end of the stay 264 slides downwardly with respect to the prop, tucking itself into the channel provided as illustrated in FIG. 27.

Although the prop 244 in the embodiment shown must be moved manually between its open and closed positions, apparatus may be provided to automatically open and close this member as the ladder is erected and folded, respectively.

The two outer stiles 236 and 238 are formed as channel members having a U-shaped portion 265, 266 and an extension portion 268, 270, as shown in FIG. 27. When the ladder is folded together, the U-shaped portions enclose the steps 252, 254, 256, and 258, the straps 248, 250 and the support struts 260, 262. The extension portions 268 and 270 fold over the prop 244 and stay 264 so that all of the elements of the ladder are covered, as shown in FIG. 26, when the ladder is closed.

While various preferred embodiments have been described above, it will be understood that the present invention is susceptible to various modifications, changes and adaptations as will occur to those skilled in the art. By way of example, and not limitation, a few of these variations will now be described:

As explained above in connection with FIGS. 6–11, a block 172 having a T-shaped portion 176 is provided adjacent the lower end of the rear wall 14E of the front stile. This T-shaped portion 176 engages the lower end of the channel 100 formed at the front of the rear stile when the rear stile is to be retained against the front stile in a storage position. This arrangement requires that the rear stile be lifted manually off of the block 172 when the rear stile is to be pivoted outward into the step-ladder or inverted V configuration.

It may be desirable in some instances, particularly with small ladders intended for household use, to replace the block 172 with a simple detent so that the rear stile may be swung directly outwardly away from the front stile without first unlatching and raising it upward.

While the preferred embodiment disclosed and described in connection with FIGS. 1–18 contemplates a "Unimodular" ladder system; that is, a ladder comprised of one or more identical ladder sections, each of which may be purchased separately and joined together in any desired configuration, it will be understood that the invention is not limited to this concept. When intended for general household use in particular, it may desirable to provide a somewhat simpler ladder structure comprised of only two sections which are capable of being extended to form a straight extension ladder, or may be pivoted into the step-ladder or inverted V configuration. In this case, the two ladder sections need not be identical.

For example, in this simplified ladder the front ladder section (which remains the lower section when the ladder is extended), need not be provided with a slanted or cut away portion at the end of the central stile, or with sliding grooves along the front side of the central stile. Further, since the ladder will not be extended beyond two sections, it may not be necessary to provide a self-tightening latch.

Similarly, in a two-section ladder the rear section will, of course, not require a latch or any other means of support for retaining a further section on its rear side.

It will be appreciated that the ladder according to the present invention combines various features which contribute to making a common device extremely safe and useful. By forming the ladder of three parallel stiles, interconnected by transverse steps, the strength of the ladder is considerably increased. This structure also increases the user's safety because the feet of the person using the ladder are constrained to the space between the centre and outer stiles, and therefore cannot slide sideways as is possible with conventional two-stile ladders.

The foldability of the ladder according to the present invention has the obvious advantage of facilitating the portability of the ladder and minimizing the space required in storage.

Finally, the ability to support the upper end of the central stile of the ladder according to the present invention achieves three principal purposes: First, it increases the safety when the ladder is leaned against a building or other upright supporting surface because it utilizes the principle of the "three point" contact. Second, it frees the design of side or outer stiles so that they can be more particularly tailored to their function as handrails and support members for the individual steps. And third, it facilitates the construction of a Uni-modular ladder section which, when combined with other identical sections, form an extremely useful and flexible ladder system.

What I claim as my invention and desire to secure by Letters Patent is:

1. A foldable and extendable ladder having at least two ladder sections, each section comprising:

a central elongate support member and two outer elongate members arranged one on each side of, and substantially parallel to, the central member; a series of rungs disposed at spaced intervals on each side of the central member and foldably connected to the central member and one of the outer members, each rung being arranged to fold between an operative position, in which it extends generally at right angles to the longitudinal direction of each member to which it is connected, and a storage position in which the rung lies substantially parallel to the central member with the outer member to which it is connected extending parallel to and in close juxtaposition with the central member;

wherein the ladder sections each have a front face and a rear face and are adapted to be moved relatively to one another between an aligned position one behind the other and a number of extended, partially overlapping parallel positions, the central support members having slidably cooperating parts to provide captive location of one central support member behind the other during their relative movement, whereby the rungs of each ladder section are capable of being in either the operative or storage positions in the relatively aligned and extended positions of the central support members.

2. The ladder defined in claim 1, wherein a rear ladder section is adapted to be moved upward to said extended, partially overlapping positions.

3. The ladder defined in claim 1, wherein one of said central support members includes a sliding surface, formed integrally therewith and extending substantially the entire length thereof, said sliding surface providing captive location of the cooperating part on an adjacent central support member.

4. A portable ladder comprising two or more ladder sections each comprising:

an elongate central element, two elongate outer elements arranged one at each of opposite sides of the central element, and a plurality of steps disposed at spaced intervals on each of said opposite sides of the central element and foldably connected both to the central element and to the respective one of the outer elements, each outer element with its associated steps being arranged to fold between an erected position with the outer element spaced from the central element and the steps extending outwardly from the central element, and a storage position in which the outer element and the steps lie adjacent and substantially parallel to the central element, the sections having respective parts which are engageable with one another to support one section above the other to form a two section ladder assembly.

5. A ladder as claimed in claim 4, in which the extent to which said sections overlap may be varied with the outer elements and associated steps in either their erected or storage positions.

6. A ladder as claimed in claim 4, in which said respective parts include respective slidably co-operating parts on the ladder sections adapted to provide captive location of the sections with one central element behind the other during all, or substantially all, of relative sliding movement between the sections.

7. A ladder as claimed in claim 6, in which said slidably co-operating parts include a first sliding surface disposed on a first of the central elements and a second sliding surface disposed on the second of the central elements, said first and second surfaces being arranged to engage each other to prevent separation of said central elements in a direction normal to the sliding surfaces while permitting relative sliding in the longitudinal direction of the central elements, one of said first and second sliding surfaces facing inwardly and the other facing outwardly with respect to said first central element, when the slidably co-operating parts are in engagement.

8. A ladder as claimed in claim 4, in which the steps of each section are angled in a plane transverse to the central element thereof when in the erected position to accommodate the natural splay of the feet of a person using the ladder.

9. A ladder as claimed in claim 4, in which the steps on one side of the central elements each share a common pivot member, with a respective one of the steps on the other side.

10. A ladder as claimed in claim 4, in which the steps of each said section on one side of the central element thereof are connected to the respective outer element in such a way that all of those steps may be folded together between said erected and said storage positions.

11. A ladder as claimed in claim 4, in which one of the ladder sections further comprises means connected to the central element thereof for supporting the lower end of that central element from the ground or other surface when the ladder section is in a generally upright or inclined working configuration.

12. A ladder as claimed in claim 11, in which said means for supporting that central element is adapted to engage the ground or other surface at points more widely spaced than the outer elements in their erected position.

13. A ladder as claimed in claim 11, in which said means for supporting that central element is foldable between an operative position to engage the ground or surface and a storage position generally parallel with that central element.

14. A ladder as claimed in claim 11, in which said means for supporting that central element comprises leg means including at least two leg structures connected to said first central element adjacent one of its ends, at least one of said leg structures having means for adjusting the position of the outer end thereof, thereby permitting differential adjustment of said leg structures to level the ladder in use.

15. A ladder as claimed in claim 4, including strut means arranged to form a triangulated load bearing configuration with at least a portion of a step and at least a portion of one of the elements to support the step in its erected position.

16. A portable extension ladder comprising two or more ladder sections each comprising:

an elongate central element, two elongate outer elements arranged one at each of opposite sides of the central element, and a plurality of steps disposed at spaced intervals on each of said opposite sides of the central element and foldably connected both to the central element and to the respective one of the outer elements, each outer element with its associated steps being arranged to fold between an erected position with the outer element spaced from the central element and the steps extending outwardly from the central element, and a storage position in which the outer element and the steps lie adjacent and substantially parallel to the central element, and the sections having respective parts which are engageable with one another to support one section on the other in at least partially, overlapping relationship to form an extension ladder assembly.

17. A portable ladder assembly comprising two sections each comprising an elongate central element, two elongate outer elements arranged one at each of opposite sides of the central element, and a plurality of steps disposed at spaced intervals on each of said opposite sides of the central element and foldably connected both to the central element and to the respective one of the outer elements, each outer element with its associated steps being arranged to fold between an erected position for use with the outer element spaced from the central element and the steps extending outwardly from the central element, and a storage position in which the outer element and steps lie adjacent and substantially parallel to the central element, one of the sections being provided at one end with engaging means for engaging co-operating means on the other of the sections to permit relative movement of the two sections between an arrangement with one section supported above the other as a two section ladder and an arrangement in which the two sections include an acute angle between them to form a step-ladder.

18. A portable ladder assembly comprising two sections each comprising an elongate central element, two elongate outer elements arranged one at each of opposite sides of the central element, and a plurality of steps disposed at spaced intervals on each of said opposite sides of the central element and foldably connected both to the central element and to the respective one of the outer elements, each outer element with its associated steps being arranged to fold between an erected position for use with the outer element spaced from the central element and the steps extending outwardly from the central element, and a storage position in which the outer element and steps lie adjacent and substantially parallel to the central element, one of the sections being provided at one end with engaging means for engaging co-operating means on the other of the sections to permit linear relative movement of the sections between overlapping positions, as an extension ladder, and limited pivotal movement between the two sections whereby the sections may be arranged to include an acute angle between them as a step-ladder.

19. A portable ladder assembly comprising at least three sections each comprising an elongate central element, two elongate outer elements arranged one at each of opposite sides of the central element and a plurality of steps disposed at spaced intervals on each of said opposite sides of the central element and foldably connected both to the central element and to the respective one of the outer elements, each outer element with its associated steps being arranged to fold between an erected position for use with the outer element spaced from the central element and the steps extending outwardly from the central element, and a storage position in which the outer element and steps lie adjacent and substantially parallel to the central element, a first of the sections being adapted at one end for assembly upon a second of the sections as a two section ladder and being provided at the other end with engaging means for engaging co-operating means on a third of the sections to permit linear relative movement of the first and third sections between overlapping positions as an extension ladder and pivotal movement between the two sections whereby the sections may be arranged to include an acute angle between them to form a support for the upper end of the two section ladder.

20. A portable foldable ladder comprising a ladder structure having an elongate central element, two elongate outer elements arranged one at each of opposite sides of the central element, and a plurality of steps disposed at spaced intervals on each of said opposite sides of the central element and foldably connected both to the central element and to the respective one of the outer elements, each outer element with its associated steps being arranged to fold between an erected position for use with the outer element spaced from the central element and the steps extending outwardly from the central element, and a storage position in which the outer element and the steps lie adjacent and substantially parallel to the central element, and a leg structure arranged on the ladder structure to be foldable between an open position to engage the ground or other surface at points spaced further apart than the outer elements in their erected position thus to support the ladder structure from the ground or other surface in use, and a storage position to lie substantially parallel to the outer elements in their storage position.

21. A portable foldable ladder comprising a ladder structure having an elongate central element, two elongate outer elements arranged one at each of opposite sides of the central element, and a plurality of steps disposed at spaced intervals on each of said opposite sides of the central element and foldably connected both to the central element and to the respective one of the outer elements, each outer element with its associated steps being arranged to fold between an erected position for use with the outer element spaced from the central element, and a storage position in which the outer element and the steps lie adjacent and substantially parallel to the central element, and a leg structure including elements foldably connected to one end of the central element for movement between an open position to engage the ground or other surface at points spaced further apart than the outer elements in their erected position thus to support the ladder structure from the ground or other surface and a storage position in which they lie substantially parallel to the outer elements in their storage position.

22. A portable foldable ladder module comprising:

an elongate central element, two elongate outer elements arranged one at each of the opposite sides of the central element, and a plurality of steps disposed at spaced intervals on each of said opposite sides of the central element and foldably connected both to the central element and to the respective one of the outer elements, each outer element with its associated steps being arranged to fold between an erected position for use with the outer element spaced from the central element, and the steps extending outwardly from the central element, and a storage position in which the outer element and the steps lie adjacent and substantially parallel to the central element, the module being provided with first and second engagement means disposed so that the first engagement means may co-operate with the second engagement means of a further such module whereby a plurality of such modules may be assembled together as a ladder of greater length than the module.

23. A ladder module as claimed in claim 22, in which said first and second engagement means are adapted to slidably co-operate to provide captive location on one module behind another such module during relative sliding movement between the modules.

24. A ladder module as claimed in claim 22, in which the steps are angled in a horizontal plane transverse to the central element, when in an erected position to accommodate the natural splay of the feet of person using the module.

25. A ladder module as claimed in claim 22, in which the central element has a cross-section including a hollow box shape, opposite sides of the box forming two opposite sides of the central element and, being inclined toward each other, and in which said steps extend outwardly approximately normal to said two opposite sides when in an erected position, whereby the steps are angled in a plane transverse to the central element when in the erected position to accommodate the natural splay of the feet of a person using the module.

26. A ladder module as claimed in claim 22, in which the steps on one side of the central elements each share a common pivot member, with a respective one of the steps on the other side.

27. A ladder module as claimed in claim 22, in which the steps on one side of the central element are connected to the respective outer elements in such a way that all of these steps may be folded together between said erected position and said storage position.

28. A ladder module as claimed in claim 22, including means connected to the central element for supporting one end thereof on the ground or other surface when the ladder module is in a generally upright or inclined working configuration.

29. A ladder module as claimed in claim 22 including means, disposed on the central element, for detachably retaining at least one leg structure capable of supporting the lower end of the module from the ground or other surface, when such module is in a generally upright, or inclined working configuration.

30. A ladder module as claimed in claim 22, wherein said first engagement means engages co-operating second engagement means on another module to permit relative movement of the two modules between an arrangement with one module supported above the other as a two section ladder and an arrangement in which the two modules include an acute angle between them to form a step-ladder.

31. A portable foldable ladder comprising a ladder structure having:

an elongate central member, two elongate outer members arranged one at each of opposite sides of the central member, a plurality of steps disposed at spaced intervals on each of said opposite sides of the central member, and foldably connected both to the central member and to the respective one of the outer members, each outer member with its associated steps being arranged to fold between an erected position for use with the outer member spaced from the central member and the steps extending outwardly from the central member, and a storage position in which the outer member and the steps lie adjacent and substantially parallel to the central member, and releasable means for supporting said steps in their erected position:

the ladder structure being arranged at one end to engage the ground at two spaced points to support it above the ground or other surface, and having a foldable support member arranged to engage the ground or other surface at a third point when in an open position so that the ladder is supported at three points in use.

32. A foldable ladder comprising, in combination:

a central elongate member and two outer elongate members arranged one on each side of, and substantially parallel to, the central member, a series of rungs each foldably connected to the central member and one of the outer members, each rung being arranged to fold between an operative position, in which it extends generally at right angles to the longitudinal direction of each member to which it is connected, and a storage position in which the rung lies substantially parallel to the central member with the outer member to which it is connected extending parallel to and in close juxtaposition with the central member;

the rungs of said ladder being angled in a plane transverse to the central element thereof when in the erected position to accommodate the natural splay of the feet of a person using a ladder and, with the central and outer members, to form a cradle for the body of a user when the ladder is in a substantially upright, leaning and working configuration.

33. The foldable ladder defined in claim 32, wherein said rung is foldably connected to the central member by means of pivots, the plane of the axes of said pivots on one side of said central member being angled with respect to the plane of the axes of said pivots on the other side thereof, each plane of the axes of said pivots being substantially parallel to said central member and substantially transverse to the plane of the axes of said rungs on the same side of said central member.

* * * * *